US006920823B2

(12) United States Patent
Nukada et al.

(10) Patent No.: US 6,920,823 B2
(45) Date of Patent: Jul. 26, 2005

(54) PHOTOSENSITIVE DEVICE, IMAGE FORMING APPARATUS AND METHOD FOR FORMING IMAGES

(75) Inventors: Hideki Nukada, Kanagawa-ken (JP); Kenichi Takahara, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/792,834

(22) Filed: Mar. 5, 2004

(65) Prior Publication Data

US 2004/0234313 A1 Nov. 25, 2004

(30) Foreign Application Priority Data

Mar. 31, 2003 (JP) ..... 2003-095082

(51) Int. Cl.[7] ..... B41M 1/14

(52) U.S. Cl. ..... 101/175; 101/135; 101/177; 101/378; 101/382.1; 101/389.1; 101/415.1

(58) Field of Search ..... 101/175, 135, 101/177, 382.1, 415.1, 378, 389.1

(56) References Cited

U.S. PATENT DOCUMENTS 6,026,747 A * 2/2000 Carme et al. ..... 101/415.1
6,539,859 B2 * 4/2003 Williams ..... 101/175
2004/0040457 A1 * 3/2004 McManus ..... 101/409

FOREIGN PATENT DOCUMENTS

JP 62-26468 6/1987
JP 62-51472 10/1987

* cited by examiner

*Primary Examiner*—Ren Yan
*Assistant Examiner*—Kevin D. Williams
(74) *Attorney, Agent, or Firm*—Oblon, Spivak, McClelland, Maier & Neustadt, P.C.

(57) ABSTRACT

A photosensitive device has a cylinder, a photosensitive sheet slidably wrapping outer surface of the cylinder, and a feeding roller in the cylinder. The feeding roller feeds the photosensitive sheet to the outer surface of the cylinder sequentially. The photosensitive device also has a winding roller in the cylinder. The winding roller rolls the photosensitive sheet sequentially from the outer surface of the cylinder. The photosensitive device also has an adjusting member for adjusting contact force emerged between the cylinder and the photosensitive sheet.

13 Claims, 3 Drawing Sheets

PHOTOSENSITIVE DEVICE, IMAGE FORMING APPARATUS AND METHOD FOR FORMING IMAGES

BACKGROUND OF THE INVENTION

This invention relates to a photosensitive device, an image forming apparatus and a method for forming images using them, and more specifically, to those devices and method using a long photosensitive sheet to be rolled up after usage.

A pressure transfer method is known as a prior-art transferring method for transferring the toner image formed on a photosensitive member to a medium, in order to obtain stable transferred images regardless of the sort of the medium, or of change of the environment. In the pressure transfer method, toner particles on the surface of the photosensitive member is transferred to the medium by the aid of adherence of the toner particles by pressing the photosensitive member to the medium.

For example, in a liquid-process type image-forming apparatus using liquid developer, which can realize full color images having a quality comparable to that of offset printing, the pressure transfer method is adopted. That is because this process can provide higher quality transferred images than those formed by the field transfer method that generates blur of image due to liquid carrier.

In practice, the liquid-process type image-forming apparatus produces transferred images by the pressure transfer method, in which developed images formed on the photosensitive member are transferred primarily to an intermediate transfer medium and then the developed images on the intermediate transfer medium, are transferred secondarily to the ultimate medium. When transferring is carried out by the pressure transfer method, a high pressure is generally applied to the photosensitive member. For example, a pressure of approximately 100 kgf (or 9.8 N) is applied to the photosensitive member for transferring width of 300 mm. A higher pressure and a higher temperature are required to obtain especially high transfer efficiency.

Moreover, higher transfer efficiency can be achieved by applying a shearing force as well as pressure and temperature to the contact part of the surface of the photosensitive member with the intermediate transfer medium for the pressure transfer method. Therefore, by setting a certain rotation speed ratio of the photosensitive member to the intermediate transfer medium, the intermediate transfer medium rotates together with the photosensitive member with some imposing load torque, thereby obtaining the transferred images.

Consequently, an excess load is imposed on the photosensitive member while the transferred images are obtained by the pressure transfer method, so that it is feared that life of the photosensitive member may be shortened. Furthermore, frequent replaces of the photosensitive members may result in an extreme rise of running cost, because generally a large and expensive photosensitive drum is used in the case of the liquid-process type image-forming apparatus for obtaining full color images.

A method of replacing only a photosensitive sheet but not entire drum using a long photosensitive sheet has been proposed. That is, when the photosensitive layer becomes deteriorated, spent part of the photosensitive sheet on the drum surface is wound up and a new part of the photosensitive sheet is fed to be used as disclosed in Japanese Patent Publication Numbers Sho-62-26468 and Sho-62-51472, the disclosures of which are incorporated herein by reference.

However in those references, the photosensitive sheet wrapping the drum surface is securely supported only with a feeding roll and a winding roll which winds the spent part of the photosensitive sheet. And friction coefficient between the back surface of the photosensitive sheet and the drum surface in these constructions is set as low as possible to slide easily on each other in order to facilitate winding of the photosensitive sheet.

Therefore, when transferring the developed images by the pressure transfer method is to be carried out with the above-mentioned liquid-process type image-forming apparatus, a certain load torque for imposing pressure and shearing force by the intermediate transfer medium is applied to an area. In this area, the friction coefficient between the back surface of the photosensitive sheet and the drum surface is so low that they are easy to slide on each other. Therefore, the photosensitive sheet may be off the drum or become stretched resulting in a drawback about image forming.

The present invention is intended to solve the problems mentioned above and to provide a photosensitive device and an image-forming apparatus to obtain high quality images. To this end, the photosensitive sheet and the drum are made easy to slide on each other to facilitate winding operation at the winding process of the photosensitive sheet when the photosensitive sheet for reducing running cost of the image-forming apparatus is put into practice. In addition, the photosensitive sheet is not off the drum or does not become stretched at the image-forming process to obtain high quality images. Therefore, rising of the cost can be suppressed and good image forming can be performed.

BRIEF SUMMARY OF THE INVENTION

There has been provided, in accordance with an aspect of the present invention, a photosensitive device. The photosensitive device includes: a cylinder; a photosensitive sheet slidably wrapping outer surface of the cylinder; a feeding roller which is located in the inside of the cylinder and feeds the photosensitive sheet to the outer surface of the cylinder sequentially; a winding roller which is located in the inside of the cylinder and rolls up the photosensitive sheet sequentially from the outer surface of the cylinder; and an adjusting member adjusting contact force emerged between the cylinder and the photosensitive sheet.

There has also been provided, in accordance with another aspect of the present invention, an image-forming apparatus. The image-forming apparatus includes: a cylinder; a photosensitive sheet slidably wrapping outer surface of the cylinder; a feeding roller which is located in the inside of the cylinder and feeds the photosensitive sheet to the outer surface of the cylinder sequentially; a winding roller which is located in the inside of the cylinder, and rolls up the photosensitive sheet sequentially from the outer surface of the cylinder; an image-forming member surrounding the photosensitive sheet wrapping the outer surface of the cylinder, and forming developed image on the photosensitive sheet; a transferring member transferring the developed image on the photosensitive sheet to a recording medium disposed outside of the cylinder; and an adjusting member adjusting contact force emerged between the cylinder and the photosensitive sheet.

There has also been provided, in accordance with another aspect of the present invention, a method for forming images. The method includes: providing a cylinder; providing a photosensitive sheet slidably wrapping outer surface of the cylinder; providing a feeding roller which is located in the inside of the cylinder and feeds the photosensitive sheet to the outer surface of the cylinder sequentially; providing a winding roller which is located in the inside of the cylinder and rolls up the photosensitive sheet sequentially from the outer surface of the cylinder; providing an image-forming member surrounding the photosensitive sheet wrapping the outer surface of the cylinder, and forming developed image on the photosensitive sheet; and providing a transferring member transferring the developed image on the photosensitive sheet to a recording medium disposed outside of the cylinder. The method further includes: forming developed images on the photosensitive sheet; transferring the image formed on to the recording medium disposed outside of the cylinder with a first contact pressure between the cylinder and the photosensitive sheet; and rolling up the photosensitive sheet with a second contact pressure between the cylinder and the photosensitive sheet, the second contact pressure being smaller than the first contact pressure.

In accordance with the construction mentioned above, the present invention is intended to realize an image-forming apparatus that can suppress rising of the cost thereof and provide a high quality image. That is, slipperiness of the photosensitive sheet is not deteriorated during winding operation because of a regulating member to regulate the contact force between the cylinder and the photosensitive sheet. Thus, misalignment of the photosensitive sheet with the drum or stretch thereof caused by the transferring operation may be suppressed while image-forming operation is executed so as to carry out excellent image-forming.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Figure 1:
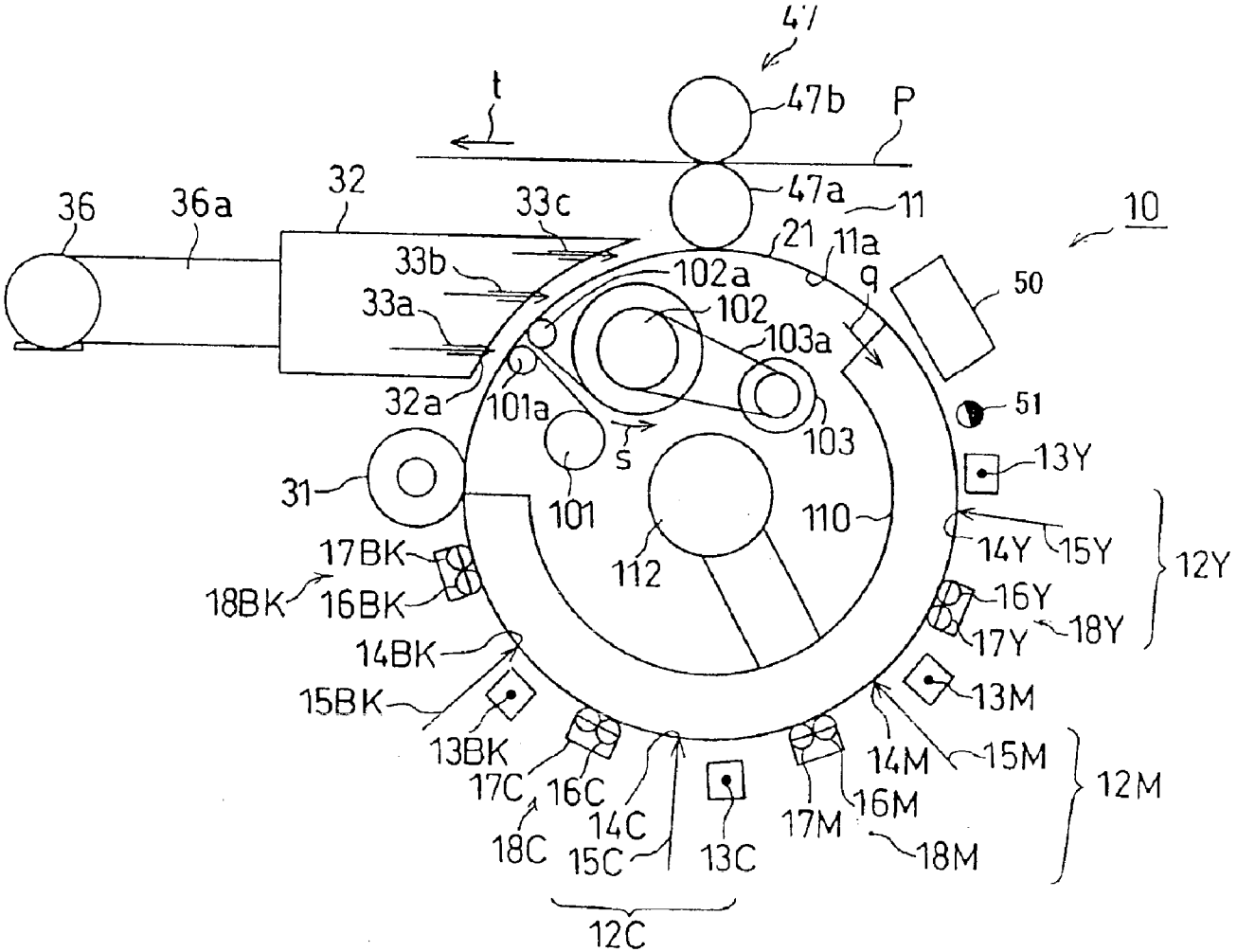
FIG. 1 is a schematic diagram showing the image-forming portion of the full color electro-photographic apparatus of an embodiment according to the present invention.

Now, some embodiments of the present invention are described in detail referring to FIGS. 1 to 4. FIG. 1 shows an image-forming portion 10 of liquid-process type full color electro-photographic apparatus that is the image-forming apparatus of the invention. The image-forming portion 10 includes a drum 11*a*, which is a cylinder, wrapped with a long and flexible photosensitive sheet 21 having a photosensitive layer, and a photosensitive device 11. A developed image is formed on the photosensitive layer.

On the periphery of the photosensitive device 11, first to fourth image-forming units 12Y, 12M, 12C and 12BK are positioned on the photosensitive sheet 21 sequentially along the rotation direction of the drum 11*a* shown as an arrow q in FIG. 1. The image-forming units 12Y, 12M, 12C and 12BK are image-forming members forming developed images by the aid of liquid carriers such as solvents of yellow (Y), magenta (M), cyan (C) and black (BK), respectively, and of respective liquid developers containing toners such as coloring materials, Although colors of the liquid developers to be used for the image-forming units 12Y to 12BK are different from each other, the units have basically the same construction except for the developers. The image-forming units 12Y to 12BK for yellow (Y) to black (BK) have charging devices 13Y to 13BK such as well-known corona charger or scorotron charger. Exposing portions 14Y to 14BK forming latent images by irradiating selectively exposing lights 15Y to 15BK by laser beams or LEDs of yellow (Y) to black (BK) modulated in compliance with image information.

The image-forming units 12Y to 12BK have developing devices 18Y to 18BK including developing rollers 16Y to 16BK accommodating liquid developers for respective colors and forming developed images by supplying the liquid developers to the surface of the photosensitive sheet 21. The image-forming units 12Y to 12BK also have squeezing rollers 17Y to 17BK positioned with a slight clearance of 20 to 50 micrometers with the photosensitive sheet 21 and removing simultaneously a fog of the developed image and the liquid carrier.

A liquid removing member 31 for removing excess liquid carrier in the developed image, which has been formed on the photosensitive sheet 21 after development, is provided at downstream side of the image-forming units 12Y to 12BK on the periphery of the photosensitive sheet 21. The liquid removing member 31 may include a sponge-like porous elastic roller for absorbing and removing the liquid carrier, or a roller formed of oleophilic material which is positioned in contact with the photosensitive member.

A nozzle block 32 is provided at downstream side of the liquid removing member 31. The nozzle block 32 dries and removes excess liquid carrier still remaining in the developed image by blowing thereon dry air. The nozzle block 32 includes three step nozzles 33*a* to 33*c* on a coating wall 32*a* coating the surface of the photosensitive sheet 21. Air generated by a blower 36 is fed to the nozzles 33*a* to 33*c* through a pipe 36*a*, and dry air of approximately 40 to 50 m/s is blown in the direction of arrow q that is the same direction as the rotating direction of the photosensitive sheet 21.

A transferring device 47 for carrying out pressure transferring process, and a cleaner 50 for removing liquid developers still remaining on the photosensitive sheet 21 after transferring process are provided at down stream side of the nozzle block 32 on the periphery of the drum 11*a*. In addition, an erase lamp 51 for erasing charges remaining on the photosensitive sheet 21 is also provided at down stream side of the nozzle block 32 on the periphery of the drum 11*a*.

The transferring device 47 includes an intermediate transfer roller 47*a* for transferring primarily the developed image formed on the photosensitive sheet 21. The transferring device 47 also includes a pressure roller 47*b* for transferring secondarily the developed image on the intermediate transfer roller 47*a* into a paper P, which is a final medium to be transferred to, by pressing the intermediate transfer roller 47*a*.

Figure 2:
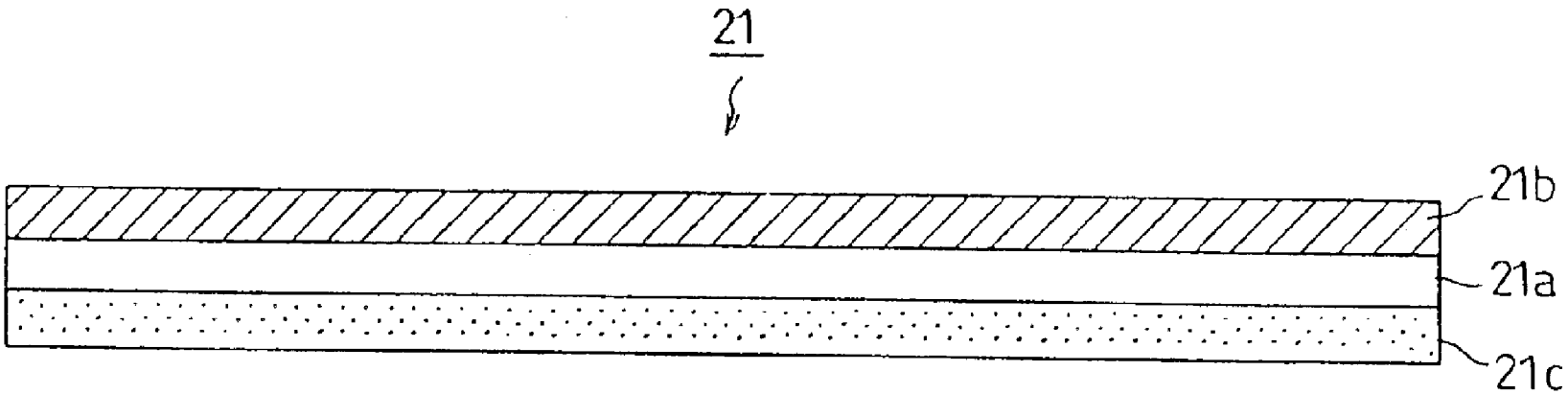
FIG. 2 is a schematic cross sectional view of a photosensitive sheet of an embodiment according to the present invention.
Figure 3:
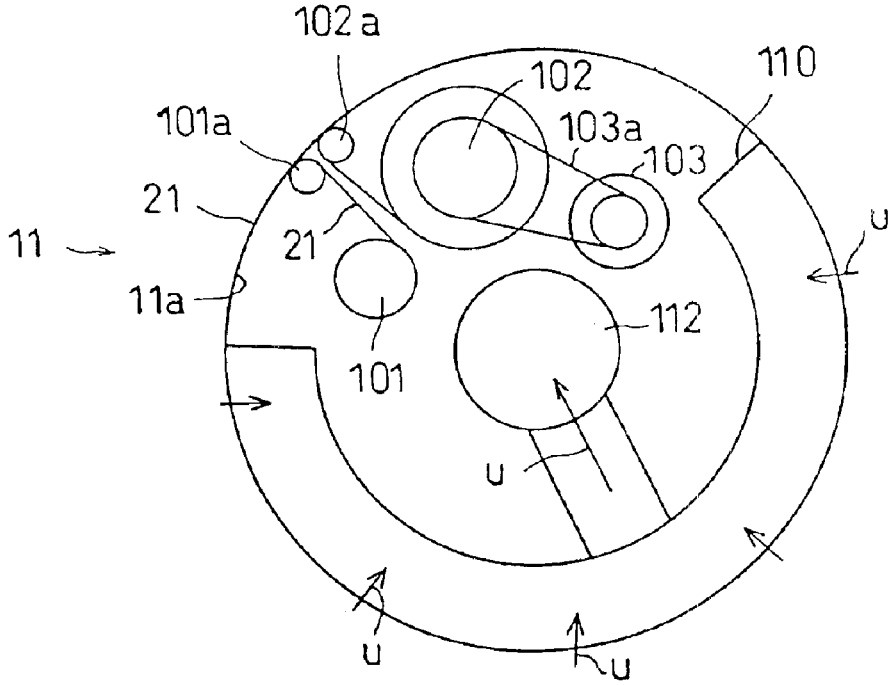
FIG. 3 is a schematic explanative diagram showing the sucking direction of air at the surface of the drum during image-forming process in an embodiment according to the present invention.
Figure 4:
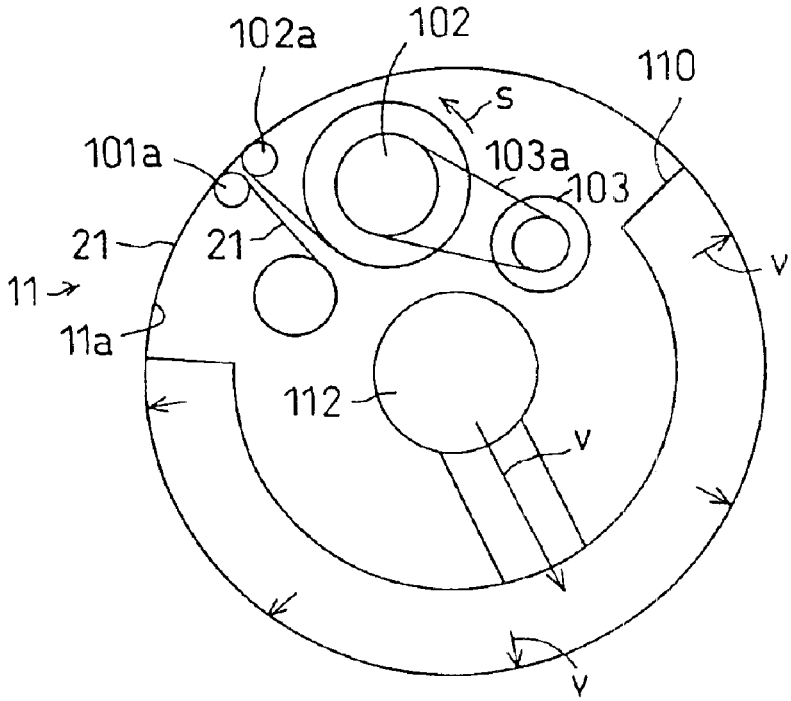
FIG. 4 is a schematic explanative diagram showing the blowing direction of air at the surface of the drum during winding process of the photosensitive sheet in an embodiment according to the present invention.

As shown in FIG. 2, the photosensitive sheet 21 is formed with a photosensitive layer 21*b* on the surface of a flexible substrate layer 21*a*. A thermo-softening material 21*c* as an adjusting member, which is heat resistant and has relatively high hardness (higher than 40 degrees), is coated on the back surface of the substrate layer 21*a*. Unused side of the photosensitive sheet 21 is accommodated in a roll shape in a feeding roll 101 via a first tension roller 101*a* contained in the hollow portion of the drum 11*a*. Spent side of the photosensitive sheet 21 is wound on a winding roll 102 via a second tension roller 102*a* contained in the hollow portion of the drum 11*a*. The winding roll 102 rotates in the direction of arrow s by a motor 103 via a timing belt 103*a*.

On the whole surface of the drum 11*a* from the first tension roller 101*a* to the second tension roller 102*a*, a large number of fine pinholes are drilled and communicate fluidly with the inside of the drum 11*a*. A duct 110 is fixed on the position facing the pinhole-formed region inside the drum 11*a*. The duct 110 is provided with an air conditioning system 112, as an adjusting member, including a blower and a compressor at the back thereof. Thus, the duct 110 can be imposed of positive and negative pressure airs interchangeably.

When a negative pressure is imposed on the duct 110 by the compressor of the air conditioning system 112, the space between the drum 11*a* and the photosensitive sheet 21 is sucked by a negative pressure air through the pinholes. Thus, the photosensitive sheet 21 wrapping the drum 11*a* is sucked uniformly toward the drum 11*a* side, as shown by the direction of arrow u of FIG. 3. When a positive pressure is imposed on the duct 110 by the blower of the air conditioning system 112, a positive pressure air is blown between the drum 11*a* and the photosensitive sheet 21 as shown by the direction of arrow v via the pinholes. Then, the contact force between the drum 11*a* and the photosensitive sheet 21 wrapping the drum 11*a* is weakened.

Now the operation is described. Before image-forming process starts, the photosensitive sheet 21 held by the feeding roll 101 and the winding roll 102 at the both sides thereof wraps the periphery of the drum 11*a* with a predetermined tension applied by the first and the second tension rollers 101*a*, 102*a*. When image-forming process starts, the drum 11*a* and the photosensitive sheet 21 rotate integrally in the direction of arrow q.

At the same time as the start of image-forming process, a negative pressure is imposed on the duct 110 by the compressor of the air conditioning system 112. Consequently, the photosensitive sheet 21 wrapping the drum 11*a* is uniformly sucked toward the drum 11*a* side due to a sucking force from the pinholes shown by the direction of arrow u in FIG. 3. Therefore, a strong contact force generates between the surface of the drum 11*a* and the photosensitive sheet 21. Thus, the photosensitive sheet 21 is fixed to the surface of the drum 11*a* over almost all surface thereof until the time when full color developed image reaches the transferring device 47 thanks to the contact forces. The contact forces are generated by adherence of the thermo-softening material 21*c* and by sucking by the air conditioning system 112

After the image-forming process has started, the photosensitive sheet 21 is charged by the charger 14Y at the image-forming unit 12Y. Then, an electrostatic latent image corresponding to the yellow (Y) image is formed thereon by being selectively exposed by laser beam 15Y corresponding to the yellow image irradiated from a laser emitting device (not shown) in compliance with the image information. Then, a toner image of yellow (Y) is formed on the photosensitive sheet 21 by the developing device 18Y of yellow (Y), and then the squeeze roller 17Y removes a fog of the image and excess liquid carrier.

Similarly, toner images of magenta (M), cyan (C) and black (BK) are sequentially superimposed by succeeding image-forming units 12M to 12BK, and a full color developed image is formed.

While the process of forming a full color developed image on the photosensitive sheet 21 is conducted, temperature of the drum 11*a* increases to approximately 40 degrees Celsius due to heat-up of the image-forming units 12Y to 12BK, etc. Thereby, the thermo-softening material 21*c* contacting the surface of the drum 11*a* is softened and becomes adhesive, and consequently the photosensitive sheet 21 obtains a strong contact force to the drum 11*a*.

Thereafter, excess liquid carrier of the full color developed image is removed by the liquid removing member 31, and then dried and removed by a high speed air jet of about 40 to 50 m/s blown from the three step nozzles 33*a* to 33*c* of the nozzle block 32, as the drum 11*a* rotates.

Then, the full color developed image, from which the excess liquid carrier has been removed as mentioned above, reaches the transferring device 47. There, the full color developed image is transferred primarily by the adherence of toner particles to the intermediate transfer roller 47*a* pressed on the photosensitive sheet 21 by the aid of the load on the pressure roller 47*b*. Then, the developed image is transferred secondarily to the paper P fed from the intermediate transfer roller 47*a* in the direction of arrow t, to form a full color image on the paper P.

During the transferring process, the drum 11*a* and the intermediate transfer roller 47*a* rotate with a certain rotating speed difference so as to impose a shearing force to the full color developed image. Thereby, a load torque is imposed on the photosensitive sheet 21 by the intermediate transfer roller 47*a*.

However, the photosensitive sheet 21 is secured uniformly to the surface of the drum 11*a* because the contact force thereof with the drum 11*a* is strengthened due to a sucking force by the air conditioning system 112 and adherence of the thermo-softening material 21*c*. In consequence, the photosensitive sheet 21 is neither off the drum 11*a* nor stretched, so that the full color developed image is transferred with high transferring efficiency to the intermediate transfer roller 47*a* and then to the paper P.

After the transferring process has finished, the cleaner 50 removes remaining toner particles from the photosensitive sheet 21, and the erasing lamp 51 erases the remaining charge. Thus, a set of image-forming process has finished and the photosensitive sheet 21 is prepared for the next set of image-forming process. When the image-forming process for predetermined number of sheets has finished, the air conditioning system 112 stops.

When the part of the photosensitive sheet 21 surrounding the drum 11*a* comes to an end of its predetermined life after the image-forming process has been repeated, the winding roll 102 is driven to wind the spent part of the photosensitive sheet on the surface of the drum 11*a*. Thus, an unused part of the photosensitive sheet 21 is fed to the surface of the drum 11*a* from the feeding roller 101 to wrap the surface of the drum 11*a* with the new photosensitive sheet 21.

The winding process or the step of replacing the part of the photosensitive sheet 21 may be preferably carried out before the image-forming process is started in a day or after the image-forming process has been finished for the day and the image-forming apparatus has been cooled down by natural cooling. The drum 11*a* is cooled at the room temperature, and the thermo-softening material 21*c* on the back surface of the photosensitive sheet 21 loses adherence because it is solidified by cooling. Therefore, contact force thereof with the surface of the drum 11*a* reduces, and thereby, friction is reduced when the photosensitive sheet 21 is wound. Thus, winding operation by the winding roll 102 becomes easy.

When the photosensitive sheet 21 is being wound, preferably a positive pressure is imposed on the duct 110 through the blower of the air conditioning system 112. The photosensitive sheet 21 is pressed outwardly by the air from the pinholes as shown by arrows v of FIG. 4 so as to be detached from the drum 11*a*. Accordingly, friction between the surface of the drum 11*a* and the photosensitive sheet 21, which emerges when the photosensitive sheet 21 is wound, is reduced remarkably. Therefore, the photosensitive sheet 21 is wound easily sliding on the surface of the drum 11*a* when winding operation by the winding roll 102 is conducted.

Each time a part of the photosensitive sheet 21 comes to an end of its life after image-forming operation has been repeated, the winding roll 102 winds the spent part of the photosensitive sheet 21 by the above-mentioned winding operation. Thus, a new part of the photosensitive sheet 21 is fed to the surface of the drum 11*a*. When the photosensitive sheet 21 wound on the feeding roll 101 is fully consumed, the whole photosensitive device 11 including the drum 11*a* is replaced by a new one.

With the construction mentioned above, the photosensitive sheet 21 is uniformly fixed to the surface of the drum 11*a* over almost whole surface thereof due to the contact force by the air conditioning system 112 and the contact force by the adherence of the thermo-softening material 21*c* during image-forming operation. Accordingly, the photosensitive sheet 21 is neither off the drum 11*a* nor stretched even when a load torque is imposed on the photosensitive sheet 21 by the pressure transferring method. In consequence, high quality images are obtained in good transferring condition.

On the other hand, when the winding roll 102 winds the photosensitive sheet 21, the surface of the drum 11*a* is cooled down and thereby the thermo-softening material 21*c* loses adherence. Moreover, friction between the surface of the drum 11*a* and the photosensitive sheet 21 is remarkably reduced to become slippery, so that winding operation for the photosensitive sheet 21 by the winding roll 102 becomes easy. In consequence, an inexpensive photosensitive device that requires less frequent replaces of the drums can be realized. Thus, image forming with low cost and high quality can be realized.

The present invention is not limited to the above-mentioned embodiment and can be modified within the scope where the purpose of the invention does not change. For instance, the adjusting member may be provided by either the thermo-softening material on the back of the photosensitive sheet or the air conditioning system if the photosensitive sheet can be fixed to the surface of a cylinder while image-forming process is conducted. If the air conditioning system is used, timing of drive thereof is arbitrary. For example, the air conditioning system may be driven in synchronization with the start of pressure transferring operation by the transferring device, but not in concurrence with the start of image-forming process.

Furthermore, timing of winding of the photosensitive sheet is not limited. In the case of using the thermo-softening material, a cooling device forcibly cooling down the cylinder may be prepared to solidify the thermo-softening material by cooling and then to wind the photosensitive sheet even in a "ready" state of the image-forming apparatus. When a whole photosensitive sheet has been used, the entire photosensitive device may not be necessarily replaced. Instead, the feeding roll and the winding roll holding the long photosensitive sheet may be formed in an integrated cartridge, and only the cartridge may be replaced. The cylinder may not be limited to the drum-shape, but other types such as an ellipse type may be used.

Preferably, tension may be imposed on the photosensitive sheet during the image-forming operation, while the tension is released during the winding-up operation. Thus, the contact force emerged between the outer surface of the cylinder and the photosensitive sheet may be adjusted. Consequently, the photosensitive sheet 21 is wound easily sliding on the surface of the cylinder during the winding-up operation, while slip of the photosensitive sheet 21 on the cylinder is suppressed during the image-forming operation. The tension adjusting member (not shown) may include a tension motor disposed in the cylinder or an elastic member steadily pulling the photosensitive sheet 21.

According to the present invention as explained hitherto, the contact force between the cylinder and the photosensitive sheet can be adjusted. The misalignment or stretch of the photosensitive sheet during image-forming process can be suppressed and image forming of high quality is obtained. On the other hand, when the photosensitive sheet is wound on the winding roller, the photosensitive sheet is pulled out smoothly.

What is claimed is:

1. A photosensitive device comprising:

a cylinder;

a photosensitive sheet slidably wrapping an outer surface of the cylinder;

a feeding roller which is located in the inside of the cylinder and feeds the photosensitive sheet to the outer surface of the cylinder sequentially;

a winding roller which is located in the inside of the cylinder and rolls up the photosensitive sheet sequentially from the outer surface of the cylinder; and an adjusting member adjusting contact force emerged between the cylinder and the photosensitive sheet, the adjusting member including a material which sticks when heated and is attached on the photosensitive sheet facing to the outer surface of the cylinder.

2. The photosensitive device according to claim 1, wherein the adjusting member decreases the contact force relatively when the winding roller is driven.

3. The photosensitive device according to claim 1, wherein the adjusting member includes an air conditioning system adjusting air pressure between the cylinder and the photosensitive sheet.

4. The photosensitive device according to claim 3, wherein the air conditioning system decreases the air pressure between the cylinder and the photosensitive sheet for enhancing the contact force.

5. The photosensitive device according to claim 1, wherein the adjusting member adjusts tension of the photosensitive sheet.

6. An image-forming apparatus comprising:

a cylinder;

a photosensitive sheet slidably wrapping an outer surface of the cylinder;

a feeding roller which is located in the inside of the cylinder and feeds the photosensitive sheet to the outer surface of the cylinder sequentially;

a winding roller which is located in the inside of the cylinder, and rolls up the photosensitive sheet sequentially from the outer surface of the cylinder;

an image-forming member surrounding the photosensitive sheet wrapping the outer surface of the cylinder, and forming developed image on the photosensitive sheet;

a transferring member transferring the developed image on the photosensitive sheet to a recording medium disposed outside of the cylinder, the transferring member including an intermediate transfer medium, which transfers the developed image on the photosensitive sheet to the recording medium by pressing contact; and an adjusting member adjusting contact force emerged between the cylinder and the photosensitive sheet, the adjusting member including a material which sticks when heated and is attached on the photosensitive sheet facing to the outer surface of the cylinder.

7. The image-forming apparatus according to claim 6, wherein the adjusting member decreases the contact force relatively when the winding roller is driven.

8. The image-forming apparatus according to claim 6, wherein the adjusting member includes an air conditioning system adjusting air pressure between the cylinder and the photosensitive sheet.

9. The image-forming apparatus according to claim 8, wherein the air conditioning system decreases the air pressure between the cylinder and the photosensitive sheet for enhancing the contact force.

10. A method for forming images comprising:

providing a cylinder;

providing a photosensitive sheet slidably wrapping outer surface of the cylinder;

providing a feeding roller which is located in the inside of the cylinder and feeds the photosensitive sheet to the outer surface of the cylinder sequentially;

providing a winding roller which is located in the inside of the cylinder and rolls up the photosensitive sheet sequentially from the outer surface of the cylinder;

providing an image-forming member surrounding the photosensitive sheet wrapping the outer surface of the cylinder, and forming developed image on the photosensitive sheet;

providing a transferring member transferring the developed image on the photosensitive sheet to a recording medium disposed outside of the cylinder;

forming developed images on the photosensitive sheet;

transferring the image formed on to the recording medium disposed outside of the cylinder with a first contact pressure between the cylinder and the photosensitive sheet;

rolling up the photosensitive sheet with a second contact pressure between the cylinder and the photosensitive sheet, the second contact pressure being smaller than the first contact pressure, providing a material which sticks when heated and is disposed between the cylinder and the photosensitive sheet; and changing contact pressure between the cylinder and the photosensitive sheet by adjusting temperature of the material.

11. The method according to claim 10, wherein the temperature is made higher during the transferring step than during the rolling-up step.

12. The method according to claim 10, further comprising:

adjusting air pressure between the cylinder and the photosensitive sheet, wherein the air pressure is lowered during the transferring step than during the rolling-up step.

13. The method according to claim 10, further comprising:

adjusting tension of the photosensitive sheet, wherein the tension is enhanced higher during the transferring step than during the rolling-up step.

* * * * *